US011137186B2

(12) United States Patent
Saito

(10) Patent No.: US 11,137,186 B2
(45) Date of Patent: Oct. 5, 2021

(54) ICE MAKING DEVICE

(71) Applicant: NIDEC SANKYO CORPORATION, Nagano (JP)

(72) Inventor: Shunji Saito, Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 126 days.

(21) Appl. No.: 16/226,676

(22) Filed: Dec. 20, 2018

(65) Prior Publication Data

US 2019/0195546 A1 Jun. 27, 2019

(30) Foreign Application Priority Data

Dec. 22, 2017 (JP) ..... JP2017-246097

(51) Int. Cl.
*F25C 1/24* (2018.01)
*F25C 5/185* (2018.01)
(Continued)

(52) U.S. Cl.
CPC ..... *F25C 1/24* (2013.01); *F25C 1/04* (2013.01); *F25C 5/04* (2013.01); *F25C 5/185* (2013.01); *F25C 2305/022* (2013.01)

(58) Field of Classification Search
CPC ..... F25C 1/24; F25C 5/04; F25C 1/04; F25C 5/185; F25C 2305/022; F25C 1/10
(Continued)

(56) References Cited

U.S. PATENT DOCUMENTS 2,032,534 A * 3/1936 Gaugler ..... F25C 1/24 62/301
2,054,101 A * 9/1936 Short ..... F25C 1/10 62/72

(Continued)

FOREIGN PATENT DOCUMENTS

CN 101520259 9/2009
CN 101520259 A * 9/2009 ..... F25C 1/08

(Continued)

OTHER PUBLICATIONS

"Office Action of China Counterpart Application", dated Jul. 3, 2020, with English translation thereof, pp. 1-13.

(Continued)

*Primary Examiner* — Eric S Ruppert
*Assistant Examiner* — Kirstin U Oswald
(74) *Attorney, Agent, or Firm* — JCIPRNET

(57) ABSTRACT

An ice making device is provided and includes: an ice tray, having water storage recessed parts; a drive unit, structured to make the ice tray perform a reversing operation and a twisting operation interlocked with the reversing operation; and a frame, holding the drive unit. The drive unit is attached to the frame by being relatively moved with respect to the frame in an attaching direction intersecting the axial direction. The frame includes: a first positioning part, positioning the drive unit in the attaching direction; and a second positioning part, positioning the drive unit in the axial direction. The second positioning part includes: a restriction part, restricting a movement to the other side in the axial direction of the drive unit; and an abutting part, abutting with the drive unit from one side in the axial direction.

8 Claims, 8 Drawing Sheets

(51) Int. Cl.
*F25C 5/04* (2006.01)
*F25C 1/04* (2018.01)

(58) Field of Classification Search
USPC ..... 62/344
See application file for complete search history.

(56) References Cited

U.S. PATENT DOCUMENTS 2,063,208 A * 12/1936 Tweedale ..... F25C 1/24 62/301
2,717,497 A * 9/1955 Knerr ..... F25C 1/04 62/137
3,059,445 A * 10/1962 Kniffin ..... F25C 1/04 62/135
3,071,933 A * 1/1963 Shoemaker ..... F25C 1/04 62/71
3,298,189 A * 1/1967 Beck ..... F25C 1/04 62/135
3,580,009 A * 5/1971 Snow ..... F25C 1/04 62/353
3,677,030 A * 7/1972 Nicholas ..... F25C 1/04 62/353
3,763,662 A * 10/1973 Nichols ..... F25C 1/24 62/353
3,863,461 A * 2/1975 Bright ..... F25C 1/04 62/137
3,871,242 A * 3/1975 Linstromberg ..... F25C 1/04 74/421 A
3,937,032 A * 2/1976 Bright ..... F16D 43/25 62/135
4,142,377 A * 3/1979 Fogt ..... F25C 1/04 62/135
4,142,378 A * 3/1979 Bright ..... F25C 1/04 62/135
4,402,194 A * 9/1983 Kuwako ..... F25C 1/04 318/282
4,628,699 A * 12/1986 Mawby ..... F25C 1/04 62/137
5,400,605 A * 3/1995 Jeong ..... F25C 1/04 62/72
9,175,892 B2 * 11/2015 Saito ..... F25C 5/187
2005/0160757 A1 * 7/2005 Choi ..... F25C 1/10 62/344
2006/0065005 A1 * 3/2006 Comerci ..... F25C 5/187 62/340
2009/0217678 A1 * 9/2009 Kim ..... F25C 5/08 62/71
2010/0037646 A1 * 2/2010 Lee ..... F25D 23/04 62/344
2010/0205996 A1 * 8/2010 Ducharme ..... F25C 5/08 62/351
2012/0240613 A1 * 9/2012 Saito ..... F25C 5/187 62/344
2017/0191722 A1 * 7/2017 Bertolini ..... F25C 5/22
2019/0063811 A1 * 2/2019 Tanimura ..... F25C 5/06
2019/0063813 A1 * 2/2019 Saito ..... F25D 23/067
2019/0068032 A1 * 2/2019 Saito ..... F25C 5/20

FOREIGN PATENT DOCUMENTS

CN 107339838 11/2017
CN 107339838 A * 11/2017
JP 2011089758 5/2011
JP 2015132448 7/2015
JP 2015132448 A * 7/2015
JP 2017161086 9/2017
JP 2017161086 A * 9/2017

OTHER PUBLICATIONS

Office Action of China Counterpart Application, with English translation thereof, dated Feb. 18, 2021, pp. 1-12.
Office Action of China Counterpart Application, with English translation thereof, dated Jun. 2, 2021, pp. 1-13.

* cited by examiner

ICE MAKING DEVICE

CROSS REFERENCE TO RELATED APPLICATION

The present application claims priority under 35 U.S.C. § 119 to Japanese Application No. 2017-246097 filed Dec. 22, 2017, the entire content of which is incorporated herein by reference.

TECHNICAL FIELD

The present disclosure relates to an ice making device in which a drive unit structured to drive an ice tray is mounted on a frame.

BACKGROUND

In Patent Literature 1 (Japanese Patent Laid-Open No. 2011-89758), an ice making device mounted on a refrigerator is disclosed. The ice making device disclosed in the Patent Literature 1 includes an ice tray whose water storage recessed parts are disposed so as to face upward, and the ice tray is performed with a reversing operation in which the ice tray is reversed around a horizontal axial line and a twisting operation interlocked with the reversing operation by the drive unit and thereby ice pieces are dropped to an ice storage container.

In the ice making device, the drive unit is held by a frame surrounding the ice tray. The drive unit is provided with a pawl part (drive side attaching part) structured to engage with the frame, and the pawl part of the drive unit is fitted to a fitted part (frame body side attaching part) of the frame and is attached to the frame. In the Patent Literature 1, the fitted part (frame body side attaching part) is formed in a top plate which closes a part of an upper face of the frame. Further, the top plate is formed with a hook-shaped coming-off prevention part (holding part) which is engaged with the drive unit attached to the top plate. Therefore, the pawl part of the drive unit is prevented from coming off from the fitted part of the frame, and the drive unit can be prevented from being disengaged from the frame.

In the Patent Literature 1, when the drive unit is to be attached to the frame, the drive unit is relatively moved with respect to the frame in a direction (horizontal direction) intersecting an output shaft with which an ice tray is connected. Therefore, the fitted part of the frame is opened in the direction (horizontal direction) that the drive unit is moved and the pawl part is inserted from the opening of the fitted part. When the drive unit is moved in a direction intersecting the output shaft, the coming-off prevention part is resiliently bent so as not to interfere with the drive unit and, when the pawl part is inserted to the back of the fitted part and the drive unit has been moved to a position where the pawl part is abutted with the fitted part, the coming-off prevention part having been resiliently bent is returned to its original position to be engaged with the drive unit.

In the attaching structure of the drive unit, the drive unit can be positioned and held by the fitted part and the coming-off prevention part in the moving direction (horizontal direction) at the time of attaching, and the drive unit can be prevented from being disengaged from the frame. However, the drive unit is not positioned in a direction (axial direction of the output shaft) intersecting the moving direction at the time of attaching and thus there is possibility that the drive unit is moved and disengaged from the frame due to an impact or vibration.

SUMMARY

In view of the problem described above, the present disclosure provides an ice making device in which a drive unit is hard to be disengaged from a frame.

To solve the above mentioned problems, an embodiment of the present disclosure provides an ice making device, including: an ice tray, having water storage recessed parts which are disposed so as to face upward; a drive unit, structured to make the ice tray perform a reversing operation around an axial line intersecting an upper and lower direction and perform a twisting operation interlocked with the reversing operation; and a frame, which holds the drive unit disposed on one side in an axial direction of the axial line with respect to the ice tray. The drive unit is attached to the frame by being relatively moved with respect to the frame to an attaching direction intersecting the axial direction. The frame is provided with a first positioning part positioning the drive unit in the attaching direction and a second positioning part positioning the drive unit in the axial direction. And, the second positioning part is provided with a restriction part restricting a movement to the other side in the axial direction of the drive unit and an abutting part abutting with the drive unit from the one side in the axial direction.

In an embodiment of the present disclosure, the drive unit is relatively moved in an attaching direction with respect to the frame and is attached to the frame. The frame is provided with the first positioning part which positions the drive unit in the attaching direction and thus the drive unit can be restrained from moving in the attaching direction to be disengaged from the frame. Further, the frame is provided with the second positioning part which is structured of the restriction part restricting a movement of the drive unit to the other side in the axial direction and an abutting part abutting with the drive unit from the one side in the axial direction and positions the drive unit in the axial direction. As a result, the drive unit can be restrained from moving in the axial direction and from being disengaged from the frame. As described above, since the drive unit is positioned in two directions, i.e., the attaching direction and the axial direction, attaching of the drive unit to the frame can be performed firmly. Therefore, a possibility that the drive unit is disengaged from the frame can be reduced.

In an embodiment of the present disclosure, it is preferable that the second positioning part positions a portion of the drive unit on a front side in the attaching direction with respect to a center in the attaching direction of the drive unit. According to this structure, influence of the second positioning part on an attaching operation of the drive unit is reduced and assemblability of the drive unit to the frame is hardly affected. Further, more preferably, the second positioning part is structured so as to position an end part on the front side in the attaching direction of the drive unit. According to this structure, the second positioning part does not influence the assemblability until a final stage of the attaching operation of the drive unit. Therefore, deterioration of the assemblability of the drive unit to the frame can be restrained.

In an embodiment of the present disclosure, it is preferable that the abutting part faces the restriction part in the axial direction. According to this structure, the drive unit can be held between the abutting part and the restriction part. Therefore, attaching of the drive unit to the frame can be performed firmly.

In an embodiment of the present disclosure, it is preferable that a dimension of the abutting part in a direction perpendicular to the attaching direction and the axial direction is substantially equal to a dimension of the drive unit in the direction perpendicular to the attaching direction and the axial direction. According to this structure, the entire drive unit in the direction perpendicular to the attaching direction and the axial direction can be supported by the abutting part. Therefore, attaching of the drive unit to the frame can be performed firmly.

In an embodiment of the present disclosure, it is preferable that the frame is provided with an auxiliary positioning part structured to restrict a movement in the axial direction of the drive unit on a rear side in the attaching direction with respect to the second positioning part. According to this structure, the drive unit can be restricted from moving in the axial direction by the second positioning part and the auxiliary positioning part. For example, when the frame is resiliently bent by an impact or the like, a movement of the drive unit can be restricted. Therefore, a possibility that the drive unit is disengaged from the frame can be further reduced.

In an embodiment of the present disclosure, it is preferable that a tip end of the auxiliary positioning part on a side of the drive unit is located at a position retreated to the one side in the axial direction with respect to a tip end of the abutting part on the side of the drive unit. According to this structure, an arrangement space in the axial direction at a position of the auxiliary positioning part is larger than that at a position of the second positioning part in the frame. Therefore, when an operation of attaching the drive unit to the frame is to be performed, the drive unit can be moved in a state that a gap space is also existed in the axial direction at a position of the auxiliary positioning part and thus the assemblability can be maintained. Accordingly, deterioration of the assemblability of the drive unit to the frame due to providing the auxiliary positioning part can be restrained. Further, since an excessive movement of the drive unit can be restricted, a possibility that the drive unit is disengaged from the frame can be further reduced.

In an embodiment of the present disclosure, the frame is provided with a mounting part on which the drive unit is mounted, the mounting part is provided with a support part having a support face which supports the drive unit in a direction perpendicular to the axial direction and the attaching direction, and a wall part which is stood up in a direction perpendicular to the axial direction and the attaching direction from an edge on the one side in the axial direction of the support part, the support part is provided with a fitted part to which a connecting part of the drive unit is fitted when the drive unit is moved to the attaching direction, and a coming-off prevention part which prevents coming-off of the connecting part from the fitted part when the drive unit has been moved to the attaching direction, the first positioning part is provided in the fitted part and the coming-off prevention part, the abutting part is a positioning rib which is protruded from the wall part, and the auxiliary positioning part is an auxiliary positioning rib which is protruded from the wall part. According to this structure, the positioning structure (positioning rib) in the axial direction hardly affects the fixing structure in which the drive unit is fitted and fixed to the support part and thus the assemblability of the drive unit to the frame can be maintained and, in addition, attaching of the drive unit to the frame can be performed firmly.

Effects of the Disclosure

In an embodiment of the present disclosure, the drive unit is relatively moved in the attaching direction with respect to the frame and is attached to the frame. The frame is provided with the first positioning part which positions the drive unit in the attaching direction and thus the drive unit can be restrained from moving in the attaching direction and from disengaging from the frame. Further, the frame is provided with the second positioning part which is structured of the restriction part restricting a movement of the drive unit to the other side in the axial direction and an abutting part abutting with the drive unit from the one side in the axial direction and positions the drive unit in the axial direction, and thus the drive unit can be restrained from moving in the axial direction and from being disengaged from the frame. As described above, since the drive unit is positioned in two directions, i.e., the attaching direction and the axial direction, attaching of the drive unit to the frame can be performed firmly. Therefore, a possibility that the drive unit is disengaged from the frame can be reduced. Further, an attaching direction of the drive unit is a direction intersecting the axial direction which is the positioning direction by the second positioning part and thus an attaching method of the drive unit is not required to change. Therefore, the assemblability of the drive unit to the frame is maintained.

Other features and advantages of the disclosure will be apparent from the following detailed description, taken in conjunction with the accompanying drawings that illustrate, by way of example, various features of embodiments of the disclosure.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION

An embodiment of the present disclosure will be described below with reference to the accompanying drawings. In the following descriptions, three directions intersecting each other are referred to as a first direction "X" (longitudinal direction), a second direction "Y" (width direction), and a third direction "Z" (upper and lower direction). Further, "X1" is indicated on one side in the first direction "X", "X2" is indicated on the other side in the first direction "X", "Y1" is indicated on one side in the second direction "Y", "Y2" is indicated on the other side in the second direction "Y", "Z1" is indicated on one side (upper side) in the third direction "Z" (upper and lower direction), and "Z2" is indicated on the other side (lower side) in the third direction "Z" (upper and lower direction).

(Entire Structure)

Figure 1:
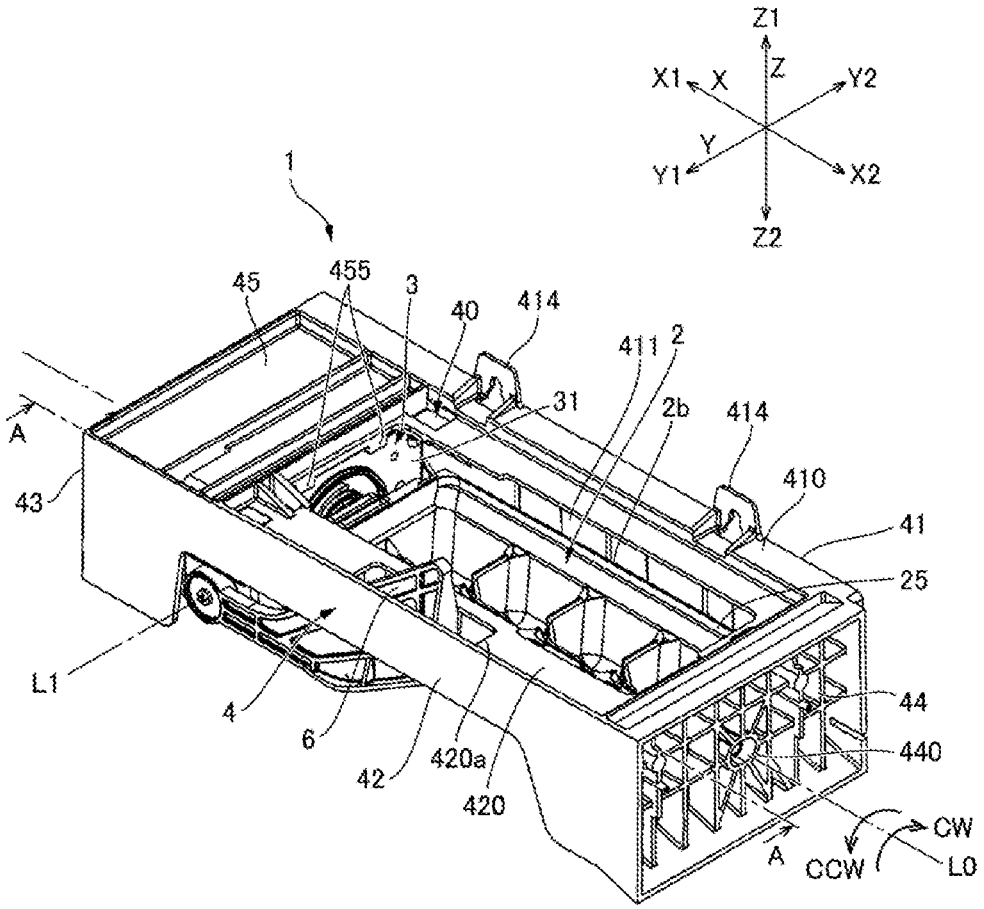
FIG. 1 is a perspective view showing an ice making device which is viewed from one side in a second direction and from an obliquely upper side in accordance with an embodiment of the present disclosure.
Figure 2:
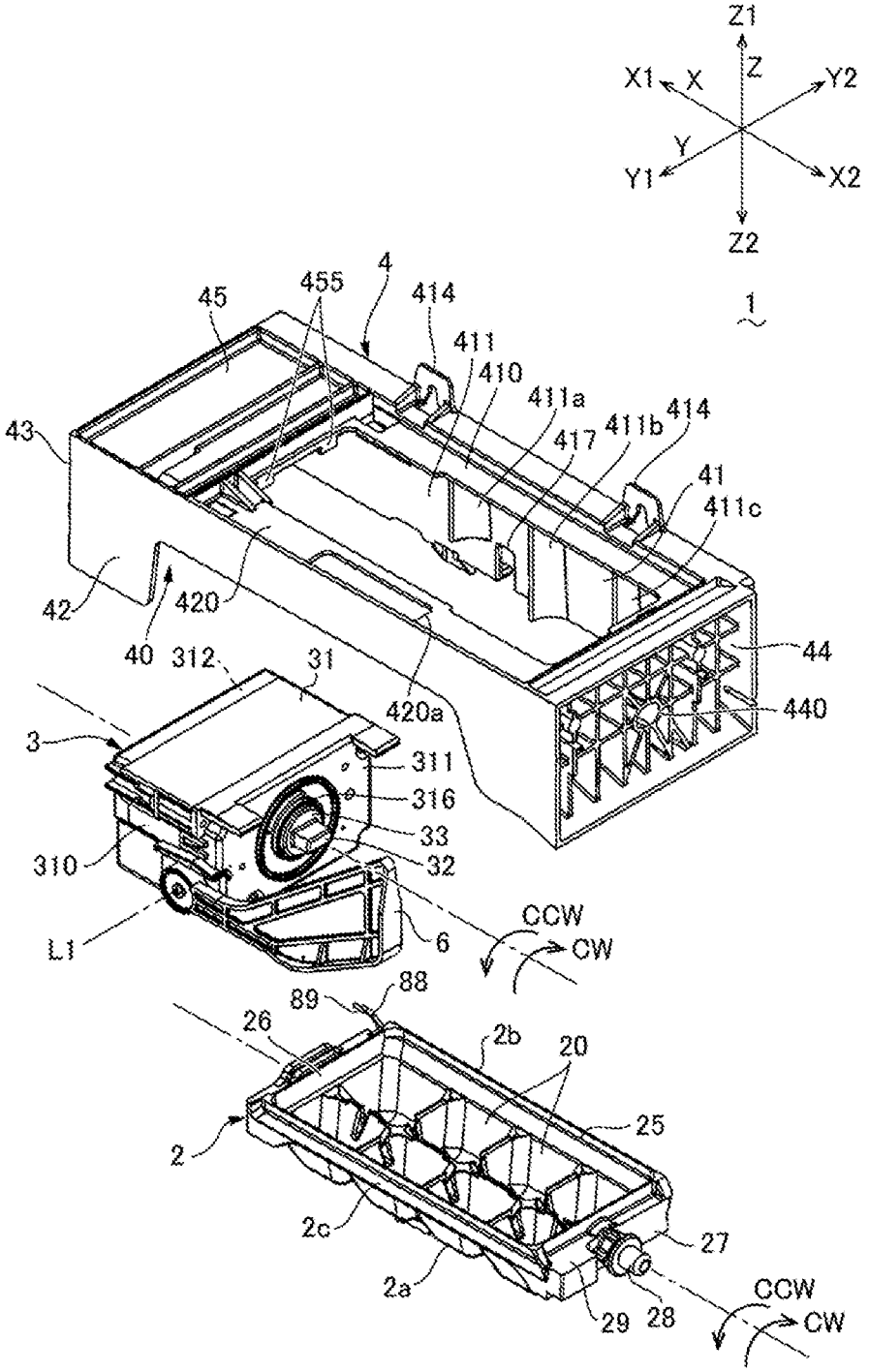
FIG. 2 is an exploded perspective view showing the ice making device shown in FIG. 1 which is viewed from one side in a second direction and from an obliquely upper side.
Figure 3:
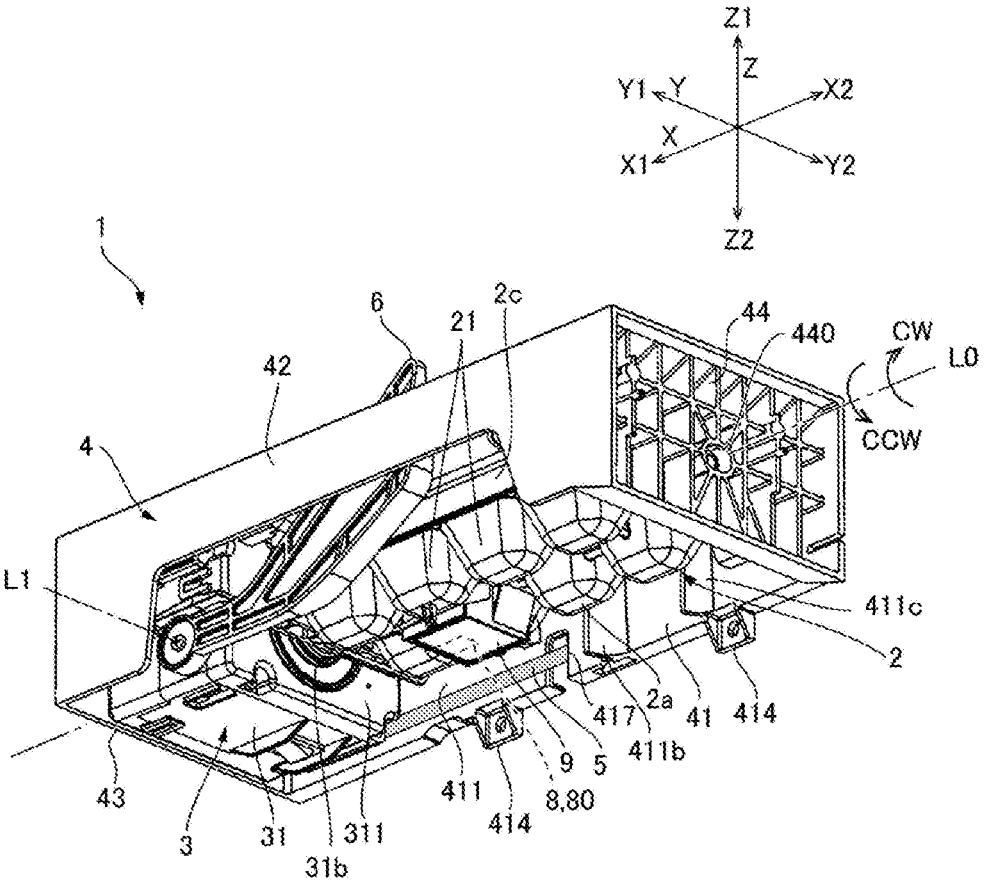
FIG. 3 is a perspective view showing the ice making device shown in FIG. 1 which is viewed from one side in a second direction and from an obliquely lower side.

FIG. 1 is a perspective view showing an ice making device 1 which is viewed from one side "Y1" in the second direction and from an obliquely upper side in accordance with an embodiment of the present disclosure. FIG. 2 is an exploded perspective view showing the ice making device 1 shown in FIG. 1 which is viewed from one side "Y1" in the second direction and from an obliquely upper side. FIG. 3 is a perspective view showing the ice making device 1 shown in FIG. 1 which is viewed from one side "Y1" in the second direction and from an obliquely lower side.

The ice making device 1 shown in FIG. 1 through FIG. 3 includes an ice tray 2 whose water storage recessed parts 20 (cells) are disposed so as to face toward one side "Z1" (upper side) in the third direction "Z", a drive unit 3 which is disposed on one side "X1" in the first direction "X" with respect to the ice tray 2, and a frame 4 provided with a mounting part 40 on which the drive unit 3 is mounted. The ice making device 1 is mounted on a refrigerator main body (not shown) and, in the refrigerator, water of a water tank (not shown) is supplied to the water storage recessed parts 20 of the ice tray 2 through a water supply pipe (not shown) and ice making is performed. When ice making is completed, the drive unit 3 drives the ice tray 2 as an ice separating operation to perform a reversing operation around an axial line "L0" extended in the first direction "X" and a twisting operation interlocked with the reversing operation and, as a result, ice pieces of the ice tray 2 are dropped to an ice storage container (not shown).

(Structure of Ice Tray 2)

The ice tray 2 is a mechanical member which is molded with resin material so that its planar shape is a substantially quadrangle and is structured of material which is capable of being elastically deformed. In the ice tray 2, a plurality of water storage recessed parts 20 is arranged in the first direction "X" and the second direction "Y". For example, as shown in FIG. 2, in the ice tray 2, two water storage recessed parts 20 are arranged as a pair in the second direction "Y" and four pairs are disposed in the first direction "X" on an inner side of a frame part 25 formed in a substantially quadrangular shape. In the frame part 25 of the ice tray 2, a wall part 26 located on one side "X1" in the first direction "X" is formed with a connecting part (not shown) which is connected with an output shaft 33 of the drive unit 3 on an axial line "L0", and a wall part 27 located on the other side "X2" in the first direction "X" is formed with a shaft part 28 which is turnably supported by the frame 4 on the axial line "L0". The wall part 27 of the ice tray 2 is formed with a turning restriction part 29 which is abutted with the frame 4 when the ice tray 2 is turned around the axial line "L0", and the turning restriction part 29 prevents turning of the ice tray 2 to make the ice tray 2 perform a twisting operation.

An under face 2*a* of the ice tray 2 facing the other side "Z2" of the third direction "Z" is arranged with a plurality of protruded parts 21 respectively reflecting shapes of the plurality of the water storage recessed parts 20. The under face 2*a* of the ice tray 2 is disposed with a temperature sensor 8 structured to detect a temperature of the ice tray 2, and the temperature sensor 8 is covered by a cover member 9 which is fixed to the under face 2*a* of the ice tray 2. Signal wiring lines 88 and 89 are extended from the temperature sensor 8 toward an inside of the drive unit 3. In this embodiment, the temperature sensor 8 is a thermistor 80.

(Structure of Drive Unit 3)

As shown in FIG. 2, the drive unit 3 includes a motor (not shown) as a drive source, a rotation transmission mechanism (not shown) structured to transmit a rotating force of the motor, and a cam gear 33 to which the rotating force of the motor is transmitted through the rotation transmission mechanism on an inner side of a case 31 which is formed in a rectangular parallelepiped shape. A wiring line (not shown) for power feeding to the motor is extended from the drive unit 3 to an outer side of the frame 4. The cam gear 33 is integrally molded with an output shaft 32 with which a connecting part of the ice tray 2 is connected. The case 31 includes a first end face 311 which faces the other side "X2" in the first direction "X" where the ice tray 2 is disposed, and a second end face 312 which faces one side "X1" in the first direction "X" on an opposite side to the ice tray 2. The output shaft 32 is protruded to an outer side of the case 31 through a hole 316 provided in the first end face 311 of the case 31. When ice pieces of the ice tray 2 are to be separated, the output shaft 32 is turned in a counterclockwise "CCW" direction with the axial line "L0" as a center and, when the ice tray 2 is to be returned to the original position, the output shaft 32 is turned in a clockwise "CW" direction.

An ice detection lever 6 is disposed at a position adjacent to the ice tray 2 on one side "Y1" in the second direction "Y". An ice detection mechanism structured to operate the ice detection lever 6 interlocked with the cam gear 33 to turn around an axial line "L1" depending on a turning angle of the cam gear 33, a switch mechanism which is operated based on a signal inputted from the temperature sensor 8 through the signal wiring lines 88 and 89, and the like are structured in an inside of the case 31 of the drive unit 3.

(Structure of Frame 4)

The frame 4 is provided with a first side plate part 41 which is extended in the first direction "X" along a first side face 2*b* on the other side "Y2" in the second direction "Y" of the ice tray 2, and a second side plate part 42 which is extended in the first direction "X" along a second side face 2*c* on one side "Y1" in the second direction "Y" of the ice tray 2. The first side plate part 41 and the second side plate part 42 are faced in parallel to each other in the second direction "Y". The ice detection lever 6 is disposed between the second side plate part 42 and the ice tray 2.

A first upper plate part 410 is projected toward the second side plate part 42 from an upper end 41*e* of the first side plate part 41 (edge on one side "Z1" in the third direction "Z"). The first upper plate part 410 is bent to a lower side at a midway position toward one side "Y1" in the second direction "Y" and then is projected toward the second side plate part 42. A second upper plate part 420 is projected from the vicinity of an upper end of the second side plate part 42 (edge on one side "Z1" in the third direction "Z") toward the first side plate part 41. The ice tray 2 is set in an opened state toward an upper side (one side "Z1" in the third direction "Z") between the first upper plate part 410 and the second upper plate part 420. The second upper plate part 420 is formed with an opening part 420*a* in which an upper end part of the ice detection lever 6 is located on its inner side.

End parts of the first side plate part 41 and the second side plate part 42 on one side "X1" in the first direction "X" are overlapped with the drive unit 3 when viewed in the second direction "Y". The first side plate part 41 and the second side plate part 42 are connected with each other by a first wall part 43 in a plate shape, which is located at an end part on one side "X1" in the first direction "X", and a second wall part 44 which is located at an end part on the other side "X2" in the first direction "X". The first side plate part 41 and the second side plate part 42 are also connected with each other by an upper plate part 45 covering the drive unit 3 from an upper side (one side "Z1" in the third direction "Z") on one side "X1" in the first direction "X". Therefore, in this embodiment, a space of the frame 4 surrounded by the first side plate part 41, the second side plate part 42, the first wall part 43 and the upper plate part 45 is structured to be a mounting part 40 for the drive unit 3. The mounting part 40 is structured in an opened state toward a lower side (the other side "Z2" in the third direction "Z"). The second wall part 44 is a wall provided with a plurality of holes which are structured by a plurality of ribs in a plate shape connected with each other. A shaft hole 440 is formed at the center so as to turnably support the shaft part 28 of the ice tray 2.

In the first side plate part 41, a plurality of reinforcing ribs 411*a*, 411*b* and 411*c* is formed so as to be extended in the upper and lower direction on a wall face (inner wall face 411) on a side where the ice tray 2 is located. In a wall (outer wall) of the first side plate part 41 on an opposite side to the ice tray 2, an upper end and a lower end of the first side plate part 41 are formed with a plurality of attaching parts 414 on the other side "X2" in the first direction "X" with respect to the drive unit 3 for fixing the frame 4 to a refrigerator main body (not shown) when the ice making device 1 is to be mounted on the refrigerator main body. The lower end of the first side plate part 41 is formed with a penetration part 417 formed of a cut-out part between the attaching parts 414 adjacent to each other in the first direction "X". The wiring line 5 structured to supply electric power to the drive unit 3 is extended from the drive unit 3 along the inner wall face 411 of the first side plate part 41 toward the other side "X2" in the first direction "X" and then is extended outside through the penetration part 417.

Therefore, when the drive unit 3 is going to make the ice tray 2 perform a twisting operation in order to perform an ice separating operation, even in a case that a large force is applied to the frame 4 due to its reaction force, transmission of the force to the side of the penetration part 417 of the first side plate part 41 is restrained by the attaching part 414 which is fixed to the refrigerator main body on one side "X1" in the first direction "X" with respect to the penetration part 417. Accordingly, stress can be restrained from being concentrated on the vicinity of penetration part 417 in the first side plate part 41 and thus the first side plate part 41 can be restrained from being damaged in the vicinity of the penetration part 417.

(Fixing Structure of Drive Unit 3 to Frame 4)

Figure 4:
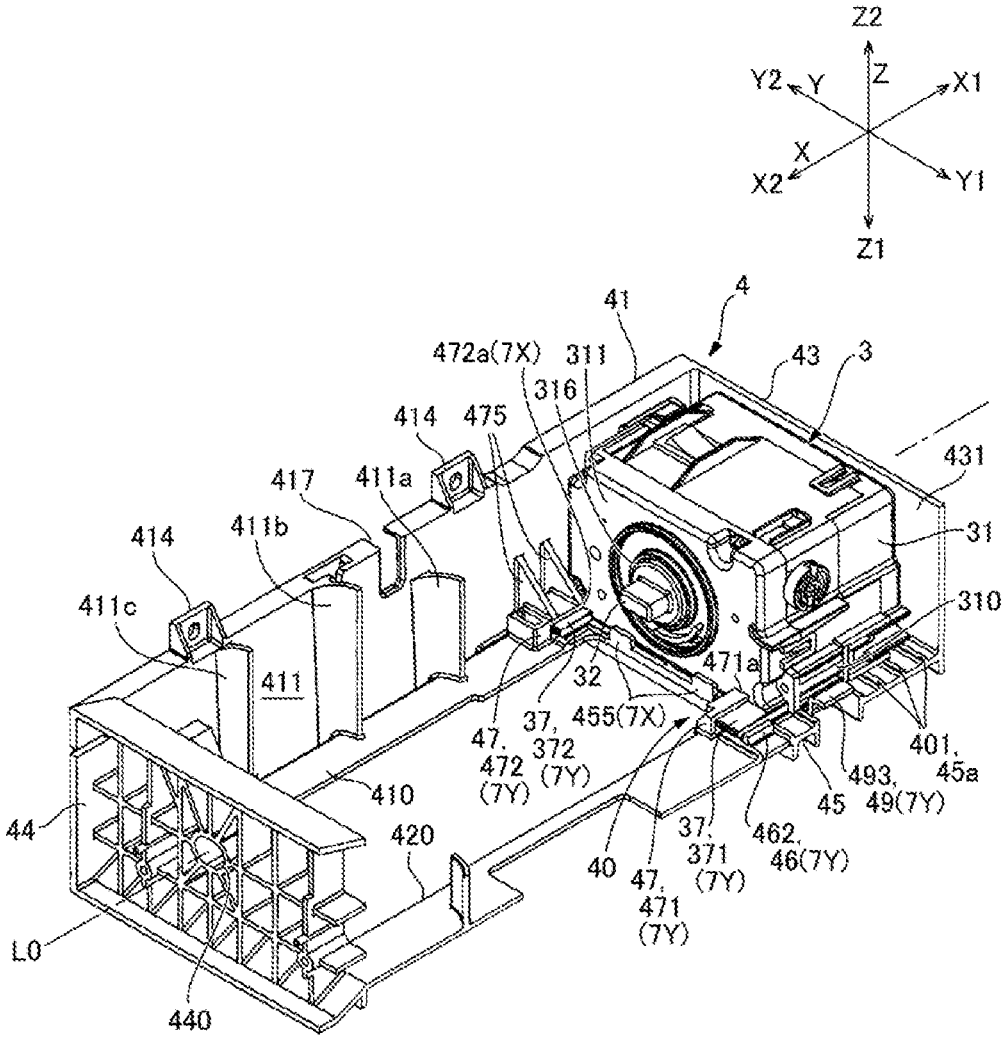
FIG. 4 is a cross-sectional perspective view (cross-sectional perspective view which is cut at the "A-A" position in FIG. 1) showing a frame and a drive unit which are reversed in a third direction and viewed from one side in a second direction and an obliquely lower side.
Figure 5:
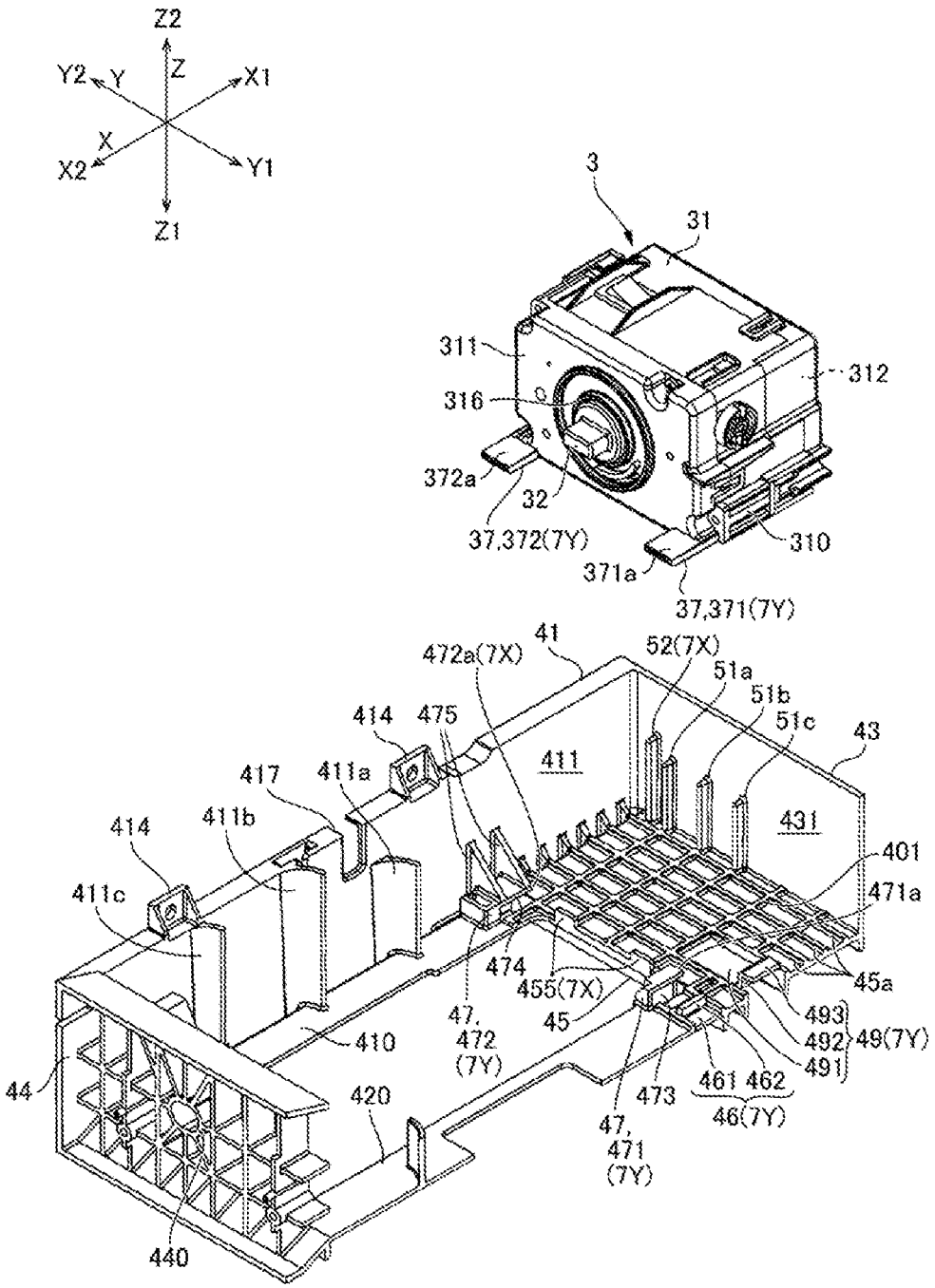
FIG. 5 is a cross-sectional exploded perspective view showing a frame and a drive unit which are reversed in a third direction and viewed from one side in a second direction and an obliquely lower side.

FIG. 4 is a cross-sectional perspective view showing the frame 4 and the drive unit 3 which are reversed in the third direction "Z" and viewed from one side "Y1" in the second direction "Y" and an obliquely lower side. FIG. 5 is a cross-sectional exploded perspective view showing the frame 4 and the drive unit 3 which are reversed in the third direction "Z" and viewed from one side "Y1" in the second direction "Y" and an obliquely lower side. FIG. 4 and FIG. 5 are a cross-sectional perspective view and a cross-sectional exploded perspective view which are cut at the "A-A" position in FIG. 1. Further, FIG. 6 is a cross-sectional view showing a state that the drive unit 3 is mounted on the mounting part 40 of the frame 4 which is viewed from a side where the ice tray 2 is disposed, and is a view showing a reversed state in the third direction "Z".

Figure 6:
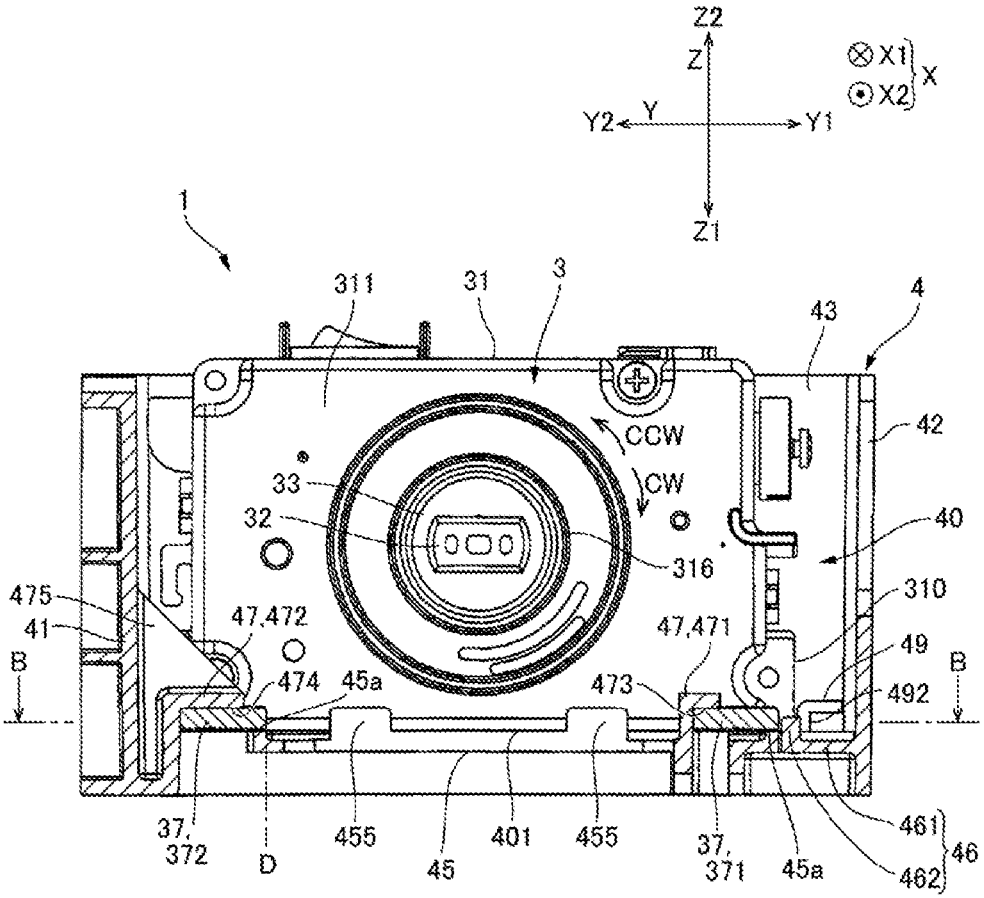
FIG. 6 is a cross-sectional view showing a state that a drive unit is mounted on a mounting part of a frame which is viewed from a side where an ice tray is disposed.

As shown in FIG. 4 through FIG. 6, the mounting part 40 of the frame 4 is provided with a support part formed with a support face 401 which supports the drive unit 3 from one side "Z1" (upper side) in the third direction "Z". In this embodiment, an upper plate part 45 which covers the drive unit 3 from an upper side is the support part. An inner face (under face) of the upper plate part 45 is formed with reinforcing ribs 45*a* which are extended in the first direction "X" and the second direction "Y". The support face 401 is structured of tip end faces of the reinforcing ribs 45*a*. Therefore, the strength of the upper plate part 45 and the support face 401 can be increased by the reinforcing ribs 45*a*.

Figure 7A:
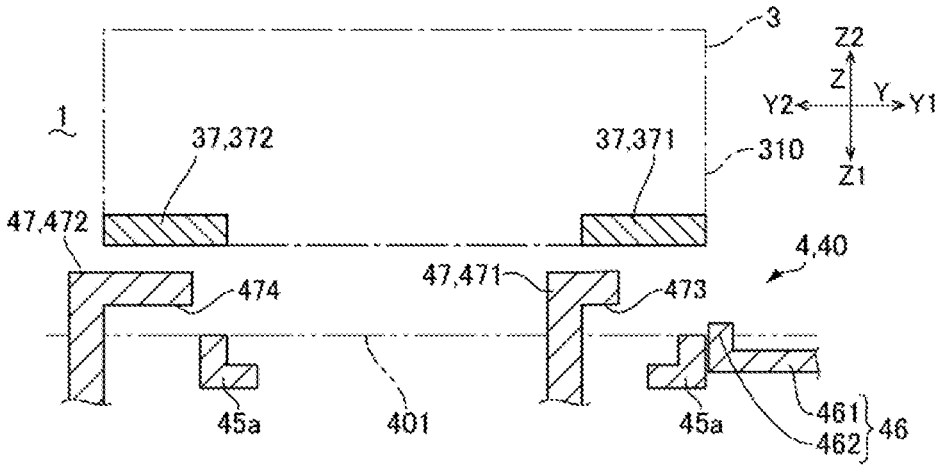
FIGS. 7A, 7B and 7C are explanatory views schematically showing fixing states of a drive unit to a frame.
Figure 7B:
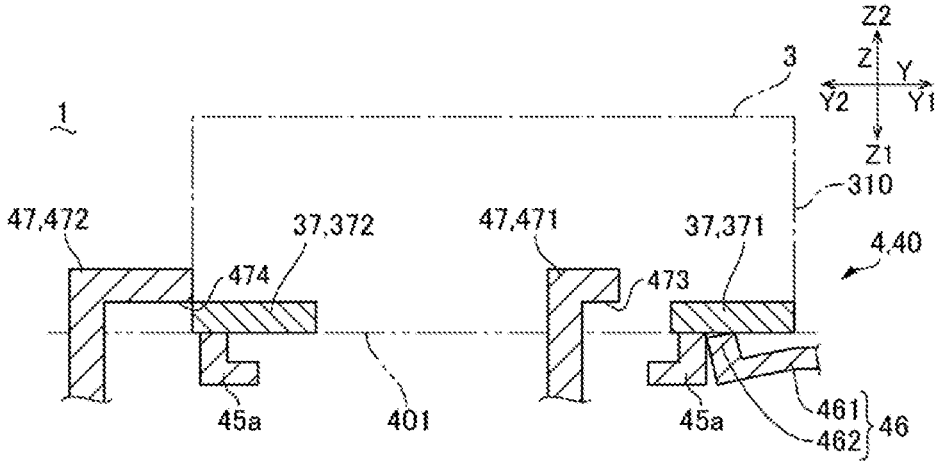
Figure 7C:
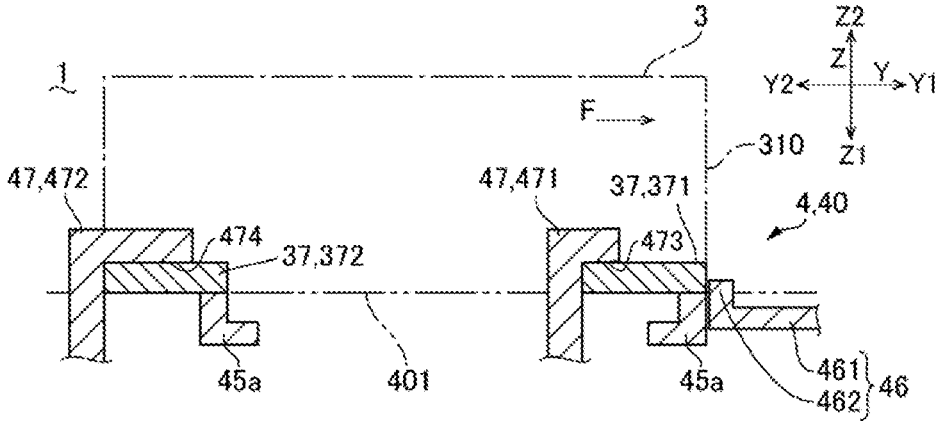

FIGS. 7A, 7B and 7C are explanatory views schematically showing a fixing structure of the drive unit 3 to the frame 4. FIG. 7A is an explanatory view showing a state before the drive unit 3 is mounted on the mounting part 40, FIG. 7B is an explanatory view showing a midway state that the drive unit 3 is mounted on the mounting part 40, and FIG. 7C is an explanatory view showing a state after the drive unit 3 has been mounted on the mounting part 40. In the ice making device 1, a direction going from one side "Y1" to the other side "Y2" in the second direction "Y" is referred to as an attaching direction of the drive unit 3 to the frame 4 and, when the drive unit 3 is moved in the direction, the drive unit 3 is fixed to the frame 4. The other side "Y2" in the second direction "Y" is a front side in the attaching direction and one side "Y1" in the second direction "Y" is a rear side in the attaching direction.

As shown in FIG. 4 through FIG. 7C, the mounting part 40 of the frame 4 is structured with a fitted part 47 to which a connecting part 37 of the drive unit 3 is fitted when the drive unit 3 is moved from one side "Y1" to the other side "Y2" in the second direction "Y", and a first coming-off prevention part 46 which is provided at a position capable of abutting with the drive unit 3 from one side "Y1" in the second direction "Y" to prevent coming-off of the connecting part 37 from the fitted part 47 when the drive unit 3 has been moved from one side "Y1" to the other side "Y2" in the second direction "Y". Further, the mounting part 40 is structured with a second coming-off prevention part 49 which is provided at a position separated to one side "X1" in the first direction "X" from the first coming-off prevention part 46 and capable of abutting with the drive unit 3 from one side "Y1" in the second direction "Y" to prevent coming-off of the connecting part 37 from the fitted part 47 when the drive unit 3 has been moved from one side "Y1" to the other side "Y2" in the second direction "Y".

The case 31 of the drive unit 3 is formed, as the connecting part 37, with a first plate part 371 which is protruded from an end part on one side "Y1" in the second direction "Y" of the first end face 311 to the other side "X2" in the first direction "X" in a state that its plate thickness direction is directed in the third direction "Z", and a second plate part 372 which is protruded from an end part on the other side "Y2" of the first end face 311 to the other side "X2" in the first direction "X" at a position separated from the first plate part 371 to the other side "Y2" in the second direction "Y" in a state that its plate thickness direction is directed in the third direction "Z". On the other hand, the upper plate part 45 of the frame 4 is formed, as the fitted part 47, a first pawl 471 which is protruded toward the other side "Z2" in the third direction "Z" and whose tip end side is bent to one side "Y1" in the second direction "Y", and a second pawl 472 which is protruded toward the other side "Z2" in the third direction "Z" and whose tip end side is bent to one side "Y1" in the second direction "Y" at a position separated from the first pawl 471 to the other side "Y2" in the second direction "Y". The first pawl 471 is provided with a recessed part 473 which is opened to one side "Y1" in the second direction "Y" and the second pawl 472 is provided with a recessed part 474 which is opened to one side "Y1" in the second direction "Y". Therefore, when the drive unit 3 is moved from one side "Y1" to the other side "Y2" in the second direction "Y", as shown in FIG. 6 and FIG. 7C, the first plate part 371 is fitted to the recessed part 473 of the first pawl 471 and the second plate part 372 is fitted to the recessed part 474 of the second pawl 472 and the drive unit 3 is fixed to the mounting part 40 of the frame 4.

In this state, an overlapping width of the second plate part 372 with the second pawl 472 in the second direction "Y" is larger than an overlapping width of the first plate part 371 with the first pawl 471 in the second direction "Y". Further, an overlapping area of the first plate part 371 with the support face 401 (overlapping area of the first plate part 371 with the reinforcing ribs 45*a* of the upper plate part 45) is larger than an overlapping area of the second plate part 372 with the support face 401 (overlapping area of the second plate part 372 with the reinforcing ribs 45*a* of the upper plate part 45).

Positions of the first pawl 471 and the second pawl 472 in the second direction "Y" are set so that a distance in the second direction "Y" between the drive unit 3 and the second side plate part 42 of the frame 4 is wider than a distance in the second direction "Y" between the drive unit 3 and the first side plate part 41 of the frame 4. Further, the first plate part 371 and the second plate part 372 are respectively fitted to the first pawl 471 and the second pawl 472 from one side "Y1" in the second direction "Y". Therefore, when the drive unit 3 is to be fixed to the mounting part 40 of the frame 4, a space can be secured that the drive unit 3 is first placed on one side "Y1" with respect to a center in the second direction "Y" as shown in FIG. 7B and, after that, the drive unit 3 is moved to the other side "Y2" in the second direction "Y". Further, a space for connecting the ice detection lever 6 shown in FIG. 1 and the like with the drive unit 3 can be secured between the drive unit 3 and the second side plate part 42 of the frame 4. In this embodiment, plate-shaped protruded parts 455 which are protruded toward the other side "Z2" in the third direction "Z" are formed at an edge of the upper plate part 45 on the other side "X2" in the first direction "X". The protruded part 455 is formed at two positions separated from each other in the second direction "Y". The protruded part 455 is provided at a position capable of abutting with the first end face 311 of the drive unit 3 from the other side "X2" in the first direction "X" to restrict a movement of the drive unit 3 to the other side "X2" in the first direction "X".

As shown in FIG. 6, the first pawl 471 is structured so that a protruded part which is protruded from the upper plate part 45 to the other side "Z2" in the third direction "Z" is provided with a recessed part 473 which is opened toward one side "Y1" in the second direction "Y" and toward one side "X1" in the first direction "X". The second pawl 472 is structured so that a protruded part which is protruded from the upper plate part 45 to the other side "Z2" in the third direction "Z" is provided with a recessed part 474 which is opened toward one side "Y1" in the second direction "Y" and toward one side "X1" in the first direction "X". The second pawl 472 is connected with the first side plate part 41 through triangular reinforcing plates 475.

On the other hand, the first plate part 371 and the second plate part 372 are formed with inclined parts 371*a* and 372*a* (see FIG. 5) which are inclined so that their plate thicknesses are reduced from one side "X1" toward the other side "X2" in the first direction "X". Therefore, when the first plate part 371 is to be fitted to an inner side of the first pawl 471, it is easily performed that the first plate part 371 is fitted to the inner side of the first pawl 471 from an end part on the other side "X2" in the first direction "X" where its plate thickness is made thin and, after that, the drive unit 3 is slid along the support face 401 toward the other side "Y2" in the second direction "Y". Further, when the second plate part 372 is to be fitted to an inner side of the second pawl 472, it is easily performed that the second plate part 372 is fitted to the inner side of the second pawl 472 from an end part on the other side "X2" in the first direction "X" where its plate thickness is made thin and, after that, the drive unit 3 is slid along the support face 401 toward the other side "Y2" in the second direction "Y".

In this embodiment, the first coming-off prevention part 46 is provided with a first arm part 461, which is extended along the support face 401 from one side "Y1" to the other side "Y2" in the second direction "Y" on one side "Y1" in the second direction "Y" with respect to the first pawl 471, and a first restriction part 462 which is protruded from a tip end side of the first arm part 461 in a direction intersecting the second direction "Y" (to the other side "Z2" in the third direction "Z") so as to be capable of abutting with the first plate part 371 of the drive unit 3 from one side "Y1" in the second direction "Y". Therefore, as shown in FIG. 7B, when the drive unit 3 is to be mounted on the mounting part 40, the first arm part 461 can be elastically deformed so that the first restriction part 462 is retreated to one side "Z1" in the third direction "Z". In addition, when completing the mounting of the drive unit 3 on the mounting part 40, the first restriction part 462 is returned to a position where the first restriction part 462 is capable of abutting with the first plate part 371 formed in the case 31 of the drive unit 3 from one side "Y1" in the second direction "Y". In other words, when completing the mounting of the drive unit 3 on the mounting part 40, the first restriction part 462 is returned to a state that the first restriction part 462 is abutted with the first plate part 371 from one side "Y1" in the second direction "Y" and, alternatively, the first restriction part 462 is returned to a position where the first restriction part 462 faces the first plate part 371 on one side "Y1" in the second direction "Y" through a gap space.

As shown in FIG. 5, the second coming-off prevention part 49 is provided with a second arm part 491, which is extended along the support face 401 from the other side "Y2" to one side "Y1" in the second direction "Y" on one side "X1" in the first direction "X" with respect to the first coming-off prevention part 46, a second restriction part 492 which is protruded from a tip end side of the second arm part 491 in a direction intersecting the second direction "Y" (to the other side "Z2" in the third direction "Z") and is capable of abutting with the drive unit 3 from one side "Y1" in the second direction "Y", and a tip end part 493 which is bent from a tip end part of the second restriction part 492 to one side "Y1" in the second direction "Y". Therefore, although not shown, when the drive unit 3 is to be mounted on the mounting part 40, the second arm part 491 can be elastically deformed so that the second restriction part 492 and the tip end part 493 are retreated to one side "Z1" in the third direction "Z" and, when completing the mounting of the drive unit 3 on the mounting part 40, the second restriction part 492 is returned to a position where the second restriction part 492 is capable of abutting with the side wall 310 of the case 31 of the drive unit 3 from one side "Y1" in the second direction "Y". In other words, when completing the mounting of the drive unit 3 on the mounting part 40, the second restriction part 492 is returned to a state that the second restriction part 492 is abutted with the side wall 310 of the case 31 of the drive unit 3 from one side "Y1" in the second direction "Y" and, alternatively, the second restriction part 492 is returned to a position where the second restriction part 492 faces the side wall 310 on one side "Y1" in the second direction "Y" through a gap space.

In this embodiment, the first coming-off prevention part 46 and the second coming-off prevention part 49 are respectively structured so that three sides are cut off in the upper plate part 45. Further, portions of the upper plate part 45 where the first pawl 471 and the second pawl 472 are formed are structured to be opening parts. Therefore, when the frame 4 is to be molded by using resin, the first coming-off prevention part 46, the second coming-off prevention part 49, the first pawl 471 and the second pawl 472 can be formed in the upper plate part 45 by using a die which is structured to be drawn in the upper and lower direction without using a slide core.

(Positioning Structure of Drive Unit)

The mounting part 40 includes a first positioning part "7Y" (see FIG. 4 and FIG. 5) which positions the drive unit 3 in the second direction "Y" in a state that the drive unit 3 has been attached to the mounting part 40. The first positioning part "7Y" is structured of the first pawl 471 formed in the upper plate part 45, the first restriction part 462 formed in the first coming-off prevention part 46, and the second pawl 472 formed in the upper plate part 45 and the second restriction part 492 formed in the second coming-off prevention part 49. In a state that the drive unit 3 has been attached to the mounting part 40, the drive unit 3 is restricted from moving to the other side "Y2" in the second direction by the first pawl 471 and the second pawl 472. Further, the drive unit 3 is restricted from moving to one side "Y1" in the second direction "Y" by the first restriction part 462 and the second restriction part 492. Therefore, the fitted part 47 (first pawl 471 and second pawl 472) of the frame 4 and the coming-off prevention part (first coming-off prevention part 46 and second coming-off prevention part 49) structure the first positioning part "7Y" which positions the drive unit 3 in the second direction "Y".

Further, the mounting part 40 includes a second positioning part "7X" which positions the drive unit 3 in the first direction "X" (in other words, axial line "L0" direction) in the state that the drive unit 3 has been attached to the mounting part 40. A structure of the second positioning part "7X" will be described below. As shown in FIG. 5, the mounting part 40 is provided with the first wall part 43 which is stood up from an edge on one side "X1" in the first direction "X" of the upper plate part 45 (support part) supporting the drive unit 3 to one side "Z1" in the third direction "Z" (in other words, to a support direction of the support face 401 for the drive unit 3). An inner wall face 431 of the first wall part 43 which faces the other side "X2" in the first direction "X" is formed with a plurality of ribs which are extended in a straight line shape from a corner part connected with the upper plate part 45 toward the other side "Z2" in the third direction "Z". In this embodiment, as the plurality of the ribs, four ribs are formed, i.e., auxiliary positioning ribs 51*a*, 51*b* and 51*c* which are connected with three ribs located on the other side "Y2" in the second direction "Y" of five reinforcing ribs 45*a* formed on the upper plate part 45, and a positioning rib 52 (abutting part) located between the auxiliary positioning rib 51*a* which is located on the most other side "Y2" and the first side plate part 41.

Each of the auxiliary positioning ribs 51*a*, 51*b* and 51*c* and the positioning rib 52 is protruded from the inner wall face 431 of the first wall part 43 to the other side "X2" in the first direction "X" which is the side where the drive unit 3 is disposed. The auxiliary positioning ribs 51*a*, 51*b* and 51*c* and the positioning rib 52 are provided at positions capable of abutting with the drive unit 3 from one side "X1" in the first direction "X" and restrict a movement of the drive unit 3 to one side "X1" in the first direction "X". In the four ribs, the positioning rib 52 is provided at an end part on the other side "Y2" in the second direction "Y" of the mounting part 40 in a corner part on one side "X1" in the first direction "X". Further, the auxiliary positioning ribs 51*a*, 51*b* and 51*c* are provided at equal intervals to the other side "Y2" with respect to the center in the second direction "Y" of the first wall part 43. The auxiliary positioning ribs 51*a*, 51*b* and 51*c* are extended to a substantially center in the third direction "Z" of the first wall part 43 and have a substantially half height of the height in the third direction "Z" of the drive unit 3. On the other hand, a height (length) in the third direction "Z" of the positioning rib 52 is higher than those of the auxiliary positioning ribs 51*a*, 51*b* and 51*c*.

Figure 8A:
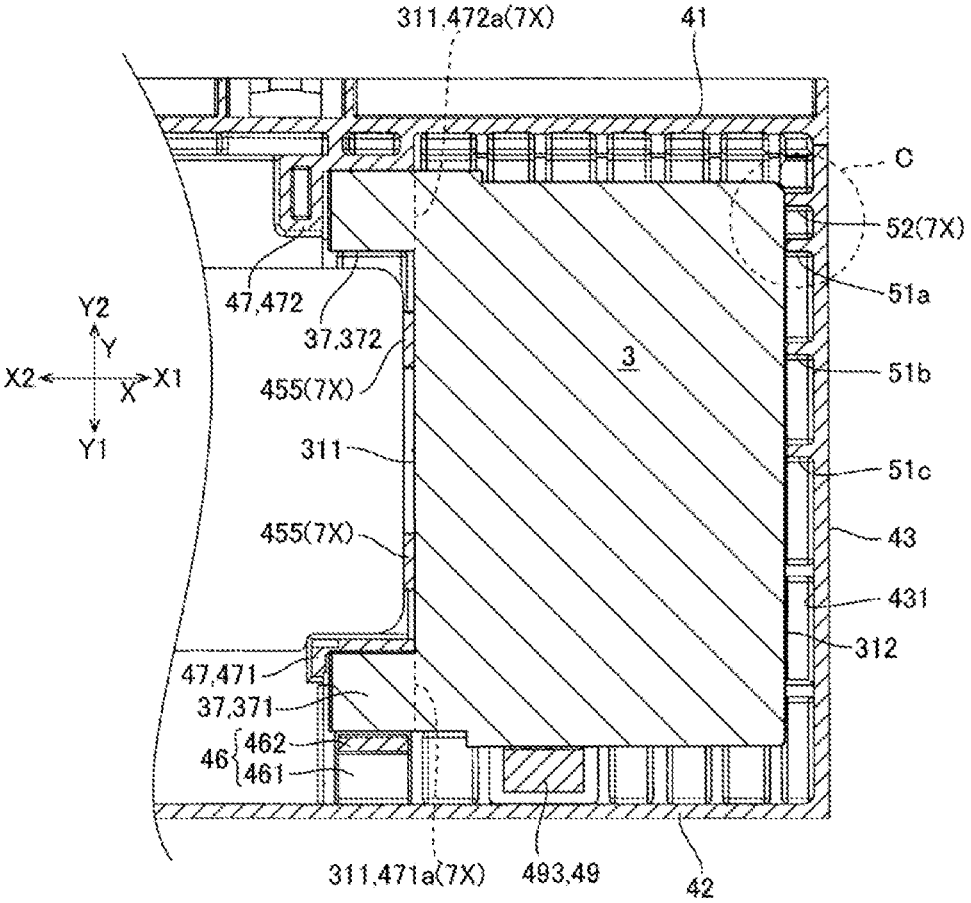
FIGS. 8A and 8B are a partial cross-sectional view showing a frame and a drive unit which is cut by an "X-Y" plane (cross-sectional view which is cut at the "B-B" position in FIG. 6), and a partial enlarged view showing a region "C" in FIG. 8A.
Figure 8B:
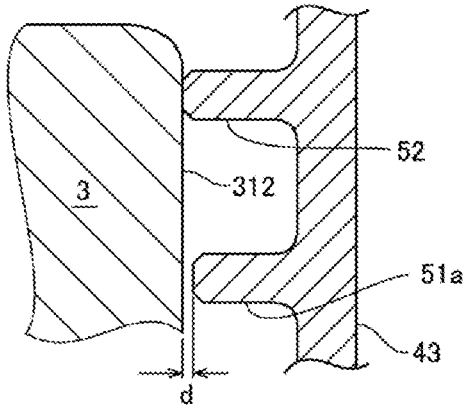

FIG. 8A is a partial sectional view showing the frame 4 and the drive unit 3 which is cut by the "X-Y" plane (cross-sectional view which is cut at the "B-B" position in FIG. 6), and FIG. 8B is a partial enlarged view showing a region "C" in FIG. 8A. As shown in FIG. 8A, the drive unit 3 is restricted from moving to the other side "X2" in the first direction by the two protruded parts 455 disposed on the other side "X2" in the first direction "X" of the drive unit 3. Further, the drive unit 3 is restricted from moving to the other side "X2" in the first direction by the first pawl 471 and the second pawl 472. An end face 471*a* on one side "X1" in the first direction "X" of the first pawl 471 and an end face 472*a* on one side "X1" in the first direction "X" of the second pawl 472 face the first end face 311 of the drive unit 3 in the first direction "X".

As shown in FIG. 8A, in an end part of the drive unit 3 on the other side "Y2" in the second direction "Y", the end face 472*a* of the second pawl 472 is abutted with the end part of the drive unit 3 from the other side "X2" in the first direction "X" and, in addition, a tip end face 520 of the positioning rib 52 is abutted with the end part of the drive unit 3 from one side "X1" in the first direction "X". Further, in a center portion of the drive unit 3, the two protruded parts 455 are abutted with the first end face 311 from one side "X1" in the first direction "X" and the auxiliary positioning ribs 51*a*, 51*b* and 51*c* face the second end face 312 from one side "X1" in the first direction "X". Further, in an end part on one side "Y1" in the second direction "Y" of the drive unit 3, the end face 471*a* of the first pawl 471 is abutted with the first end face 311 from the other side "X2" in the first direction "X".

As shown in FIG. 8B, a protruding dimension of the auxiliary positioning rib 51*a* to the other side "X2" in the first direction "X" is smaller than that of the positioning rib 52. Therefore, a tip end face 510 of the auxiliary positioning rib 51*a* is located at a position retreated to one side "X1" in the first direction "X" by a predetermined dimension with respect to the tip end face 520 of the positioning rib 52. The protruding dimensions to the other side "X2" in the first direction "X" of the three auxiliary positioning ribs 51*a*, 51*b* and 51*c* are the same as each other. Therefore, predetermined gap spaces "d" are respectively formed between the tip end faces 510 of the auxiliary positioning ribs 51*a*, 51*b* and 51*c* and the second end face 312 of the drive unit 3.

When an attaching operation of the drive unit 3 is to be performed in which the drive unit 3 is relatively moved in a direction from one side "Y1" to the other side "Y2" in the second direction "Y" with respect to the mounting part 40 of the frame 4 (in other words, the drive unit 3 is relatively moved in the attaching direction of the drive unit 3), the drive unit 3 is moved to the other side "Y2" in a state that a movement to the other side "X2" in the first direction "X" is restricted by the protruded parts 455 and in a state that the gap space "d" is existed between the drive unit 3 and the auxiliary positioning ribs 51*a*, 51*b* and 51*c*. After that, in a final stage of the attaching operation, the end part of the drive unit 3 on the other side "Y2" in the second direction "Y" is press-fitted between the end face 472*a* of the second pawl 472 and the tip end face 520 of the positioning rib 52 which are provided at the positions so as to face in the first direction "X". As a result, the drive unit 3 is positioned and fixed to the mounting part 40 in a state that the drive unit 3 is unable to move in the first direction "X".

As described above, the end faces 471*a* and 472*a* of the first pawl 471 and the second pawl 472 and the protruded parts 455, and the positioning rib 52 structure the second positioning part "7X" which positions the end part on the other side "Y2" in the second direction "Y" of the drive unit 3 in the first direction "X" (axial line "L0" direction). In this case, the first pawl 471, the second pawl 472 and the protruded parts 455 are utilized as a restriction part which restricts a movement of the drive unit 3 to the other side "X2" in the first direction "X", and the positioning rib 52 is utilized as an abutting part which is abutted with the drive unit 3 from one side "X1" in the first direction "X". The end part on the other side "Y2" in the second direction "Y" of the drive unit 3 is a portion structuring the side wall part of the case 31 of the drive unit 3 and thus, there is little possibility that the case 31 is resiliently bent even when press-fitted between the second pawl 472 and the positioning rib 52. Therefore, the drive unit 3 can be fixed firmly by positioning the end part on the other side "Y2" in the second direction "Y" of the drive unit 3 by using the second positioning part "7X".

Further, since the three auxiliary positioning ribs 51*a*, 51*b* and 51*c* are provided on one side "Y1" with respect to the positioning rib 52, a movement to one side "X1" in the first direction "X" of the drive unit 3 can be restricted by the auxiliary positioning ribs 51*a*, 51*b* and 51*c*. A movement to one side "X1" in the first direction "X" of the drive unit 3 is restricted in a wide range by a plurality of the ribs and thus the drive unit 3 can be attached further firmly.

(Operation of Ice Making Device)

In the ice making device 1 in this embodiment, in an ice making step, water is supplied through a water supply pipe (not shown) to the ice tray 2 horizontally disposed so that water storage recessed parts 20 face to an upper side and water is filled in the water storage recessed parts 20. After that, the water filled in the ice tray 2 is frozen by cold air supplied from a cooling part (not shown). Whether ice making has been completed or not is determined according to whether or not a temperature of the ice tray 2 has become a predetermined temperature or lower based on the temperature sensor 8 (thermistor 80) attached to the ice tray 2.

When ice making has been completed, an ice quantity in an ice storage container (not shown) arranged on a lower side with respect to the ice tray 2 is detected by the ice detection lever 6. Specifically, the ice detection lever 6 is driven and moved downward by the drive unit 3. In this case, when the ice detection lever 6 has been moved down to a predetermined position, it is judged that an ice quantity in the ice storage container is insufficient. On the other hand, in a case that the ice detection lever 6 is abutted with an ice piece in the ice storage container before moved down to the predetermined position, it is judged that an ice quantity in the ice storage container is full. In the case that an ice quantity in the ice storage container is full, after waited for a predetermined time period, an ice quantity in the ice storage container will be detected by the ice detection lever 6 again.

When an ice quantity in the ice storage container is insufficient, an ice separating operation of the ice tray 2 is performed. Specifically, the output shaft 32 of the drive unit 3 is driven and turned and the ice tray 2 is turned in a counterclockwise direction "CCW" with the axial line "L0" as a center. When the ice tray 2 is turned around by a predetermined turning angle of 90° or more (for example, 120°) from the horizontally disposed first position, the turning restriction part 29 of the ice tray 2 is abutted with the frame 4. In this state, further turning of the ice tray 2 is restricted and thus the ice tray 2 is twisted and deformed. As a result, ice pieces in the ice tray 2 are separated from the ice tray 2 and dropped into the ice storage container not shown arranged on a lower side with respect to the ice tray 2.

When the above-mentioned ice separating operation is performed, a force is applied to the drive unit 3 from the ice tray 2 so as to resist twisting which is applied to the ice tray 2. In this case, a force applied to the drive unit 3 is a force in the clockwise direction "CW" with the axial line "L0" as a center. On the other hand, when the drive unit 3 is to be fixed to the mounting part 40 of the frame 4, a direction in which the drive unit 3 is moved (direction in which the connecting part 37 is fitted to the fitted part 47) is the clockwise "CW" direction with the axial line "L0" as a center. Therefore, when a twisting operation is performed on the ice tray 2, the direction of the force applied to the drive unit 3 from the ice tray 2 is the same as the direction in which the drive unit 3 is moved when the drive unit 3 is to be fixed to the mounting part 40. Accordingly, when a twisting operation is performed on the ice tray 2, a force is applied to the drive unit 3 in a direction so that the connecting part 37 (first plate part 371 and second plate part 372) is fitted to the fitted part 47 (first pawl 471 and second pawl 472) and a force is not applied in a direction that the connecting part 37 is disengaged from the fitted part 47.

Further, when the twisting operation is performed on the ice tray 2, the drive unit 3 is subjected to a force in the clockwise direction "CW" from the ice tray 2 with the axial line "L0" as a center. Therefore, the first plate part 371 is pressed toward the support face 401 and the second plate part 372 is pressed toward a tip end part of the second pawl 472. Also, in this case, an overlapping width of the second plate part 372 with the second pawl 472 in the second direction "Y" is larger than an overlapping width of the first plate part 371 with the first pawl 471 in the second direction "Y". Further, an overlapping area of the first plate part 371 with the support face 401 (overlapping area of the first plate part 371 with the reinforcing ribs 45*a* of the upper plate part 45) is larger than an overlapping area of the second plate part 372 with the support face 401 (overlapping area of the first plate part 371 with the reinforcing ribs 45*a* of the upper plate part 45). Therefore, when the twisting operation is performed on the ice tray 2, even in a case that a force in the clockwise direction "CW" with the axial line "L0" as a center is applied to the drive unit 3 from the ice tray 2, a state that the drive unit 3 is fixed to the frame 4 can be surely maintained.

After the above-mentioned ice separating operation has been performed, the drive unit 3 turns the ice tray 2 in a reverse direction, i.e., in the clockwise direction "CW" so that the water storage recessed parts 20 face to an upper side with the axial line "L0" as a center, and the above-mentioned operations are repeated.

(Principal Effects in this Embodiment)

As described above, in the ice making device 1 in this embodiment, when the drive unit 3 is moved from one side "Y1" to the other side "Y2" in the second direction "Y", the connecting part 37 (first plate part 371 and second plate part 372) of the drive unit 3 is fitted to the fitted part 47 (first pawl 471 and second pawl 472) of the frame 4 and thus the drive unit 3 can be fixed to the mounting part 40 of the frame 4.

In this embodiment, the fixing structure for the drive unit 3 includes the first positioning part "7Y" which positions the drive unit 3 in the second direction "Y" and the second positioning part "7X" which positions the drive unit 3 in the first direction "X" (axial line "L0" direction). The first positioning part "7Y" is structured of the fitted part 47 (first pawl 471 and second pawl 492) of the frame 4 and the coming-off prevention part (first coming-off prevention part 46 and second coming-off prevention part 49), and a movement in the second direction "Y" of the first plate part 371 and the second plate part 372 of the drive unit 3 is restricted to position the drive unit 3 in the second direction "Y". Further, the second positioning part "7X" includes the first pawl 471, the second pawl 472 and the protruded part 455 which are restriction parts restricting a movement of the drive unit 3 to the other side "X2" in the first direction "X" and the positioning rib 52 which is an abutting part abutted with the drive unit 3 from one side "X1" in the first direction "X".

As described above, since the drive unit 3 is positioned in two directions, i.e., the second direction "Y" which is an attaching direction of the drive unit 3 to the frame 4, and the first direction "X" intersecting the second direction "Y" (axial line "L0" direction of the ice tray 2), attachment of the drive unit 3 to the frame 4 can be performed firmly. Therefore, in a case that an impact due to dropping or vibration is applied, there is little possibility that the drive unit 3 is disengaged from the frame 4. Further, an attaching direction of the drive unit 3 is a direction intersecting the positioning direction (first direction "X") by the second positioning part "7X" and thus an attaching method of the drive unit 3 is not required to change for providing the second positioning part "7X". Therefore, assemblability of the drive unit 3 to the frame 4 is hardly affected.

Further, in the second positioning part "7X", the positioning rib 52 is provided at an end part on the other side "Y2" in the second direction "Y" of the mounting part 40 and positions the end part on the other side "Y2" in the second direction "Y" of the drive unit 3. Therefore, in a case that an attaching operation of the drive unit 3 is to be performed, the positioning state by the second pawl 472 and the positioning rib 52 is not completed until the final stage of the attaching operation and thus assemblability is hardly influenced. Therefore, even when the second positioning part "7X" is provided, deterioration of assemblability of the drive unit 3 to the frame 4 can be restrained.

In accordance with an embodiment of the present disclosure, the positioning rib 52 may be disposed so as to position a part of the drive unit 3 on one side "Y1" with respect to the end part on the other side "Y2" in the second direction "Y". For example, a positioning rib 52 is formed in a range on the other side "Y2" with respect to the end part on one side "Y1" in the second direction "Y" of the second pawl 472 (on the other side "Y2" with respect to the position "D" shown in FIG. 6). In this range, when the connecting part 37 is started to be inserted into the fitted part 47, the positioning state by the positioning rib 52 is not completed. Therefore, influence on assemblability of the drive unit 3 to the frame 4 can be reduced.

The frame 4 in this embodiment includes three auxiliary positioning ribs 51*a*, 51*b* and 51*c* as the auxiliary positioning part which restricts a movement in the first direction "X" of the drive unit 3 on one side "Y1" in the second direction "Y" with respect to the positioning rib 52. Therefore, the drive unit 3 can be restricted from moving in the first direction "X" (axial line "L0" direction). For example, in a case that the frame 4 is resiliently bent due to an impact or the like, a movement of the drive unit 3 can be restricted and the drive unit 3 can be restricted from moving excessively. Therefore, possibility that the drive unit 3 is disengaged from the frame 4 can be further reduced. The auxiliary positioning ribs 51*a*, 51*b* and 51*c* are provided so that their tip ends on the drive unit 3 side are located at the positions retreated to one side "X1" with respect to the positioning rib 52 and thus, when the drive unit 3 is to be attached to the mounting part 40, the drive unit 3 can be moved in a state that the gap space "d" is existed in the first direction "X" until the final stage of the attaching operation. Therefore, assemblability can be maintained in the middle of attaching the drive unit 3.

In the second positioning part "7X" in this embodiment, the positioning rib 52 faces the second pawl 472 in the first direction "X". Therefore, in the final stage of the attaching operation of the drive unit 3, the drive unit 3 can be press-fitted and positioned between the second pawl 472 and the positioning rib 52 and thus attaching of the drive unit 3 can be performed firmly.

The positioning rib 52 is longer than a half of the dimension (height) in the third direction "Z" of the drive unit 3. Therefore, a half or more of the dimension in the third direction "Z" of the drive unit 3 can be maintained by the positioning rib 52. Accordingly, attaching of the drive unit 3 can be performed firmly and the drive unit 3 can be restrained from disengaged from the frame 4. In accordance with an embodiment of the present disclosure, it is desirable that the dimension (length) in the third direction "Z" of the positioning rib 52 is substantially equal to the dimension (height) in the third direction "Z" of the drive unit 3. According to this structure, the entire drive unit 3 in the third direction "Z" can be supported by the positioning rib 52. Therefore, attaching of the drive unit 3 can be performed firmly.

On the other hand, the auxiliary positioning ribs 51*a*, 51*b* and 51*c* in this embodiment are shorter than the positioning rib 52 and have about a half length of the dimension (height) in the third direction "Z" of the drive unit 3. Therefore, when the drive unit 3 is to be placed on the mounting part 40, the drive unit 3 can be inserted in an inclined state to one side "X1" in the first direction "X". Accordingly, in the middle of attaching the drive unit 3, assemblability can be maintained by providing flexibility in a posture of the drive unit 3 and the drive unit 3 can be firmly attached in a final stage of the attaching operation.

While the description above refers to particular embodiments of the present disclosure, it will be understood that many modifications may be made without departing from the spirit thereof. The accompanying claims are intended to cover such modifications as would fall within the true scope and spirit of the present disclosure.

The presently disclosed embodiments are therefore to be considered in all respects as illustrative and not restrictive, the scope of the disclosure being indicated by the appended claims, rather than the foregoing description, and all changes which come within the meaning and range of equivalency of the claims are therefore intended to be embraced therein.

What is claimed is:

1. An ice making device, having a longitudinal direction, a width direction, and an upper and lower direction being intersected with each other, and the ice making device comprising:

an ice tray, comprising water storage recessed parts which are disposed so as to face upward;

a drive unit, structured to make the ice tray perform a reversing operation around an axial line extended in the longitudinal direction and perform a twisting operation interlocked with the reversing operation; and a frame, which holds the drive unit disposed on one side in an axial direction of the axial line with respect to the ice tray, wherein the axial direction is the longitudinal direction;

wherein the drive unit is attached to the frame by being relatively moved with respect to the frame in an attaching direction intersecting the axial direction, wherein the attaching direction is the width direction, wherein one side in the attaching direction is defined as a rear side, and another side in the attaching direction is defined as a front side;

wherein the frame comprises:

a first positioning part, positioning the drive unit in the attaching direction, and a second positioning part, positioning the drive unit in the axial direction;

wherein the second positioning part comprises:

a first pawl, an end surface on one side in the axial direction of the first pawl faces an end surface of the drive unit in the axial direction;

a second pawl, an end surface on one side in the axial direction of the second pawl faces the end surface of the drive unit in the axial direction;

protruded parts, provided at positions being abutted with the end surface of the drive unit from another side in the axial direction; and a positioning rib, protruded from an inner wall face of a wall part of the frame to another side in the axial direction which is the side where the drive unit is disposed, wherein the first pawl, the second pawl and the protruded parts are utilized as a restriction part, restricting a movement to another side in the axial direction of the drive unit, and the positioning rib is utilized as an abutting part, abutting with the drive unit from the one side in the axial direction; wherein the protruded parts are provided at an edge of an upper plate part of the frame on the another side in the longitudinal direction, the protruded parts are protruded toward an upper side of the upper and lower direction, and the protruded parts are provided at positions separated from each other in the width direction.

2. The ice making device according to claim 1, wherein the second positioning part positions a portion of the drive unit on the front side in the attaching direction with respect to a center in the attaching direction of the drive unit.

3. The ice making device according to claim 2, wherein the second positioning part positions an end part on the front side in the attaching direction of the drive unit.

4. The ice making device according to claim 1, wherein the abutting part faces the restriction part in the axial direction.

5. The ice making device according to claim 1, wherein a dimension of the abutting part in the upper and lower direction perpendicular to the attaching direction and the axial direction is substantially equal to a dimension of the drive unit in the upper and lower direction perpendicular to the attaching direction and the axial direction.

6. The ice making device according to claim 1, wherein the frame comprises: an auxiliary positioning part, structured to restrict a movement in the axial direction of the drive unit on the rear side in the attaching direction with respect to the second positioning part.

7. The ice making device according to claim 6, wherein a tip end of the auxiliary positioning part on a side of the drive unit is located at a position retreated to the one side in the axial direction with respect to a tip end of the abutting part on the side of the drive unit.

8. The ice making device according to claim 6, wherein the frame comprises: a mounting part, on which the drive unit is mounted;

the mounting part comprises:

a support part, having a support face which supports the drive unit in the upper and lower direction perpendicular to the axial direction and the attaching direction, and the wall part, which is stood up in the upper and lower direction perpendicular to the axial direction and the attaching direction from an edge on the one side in the axial direction of the support part;

the support part comprises:

a fitted part, to which a connecting part of the drive unit is fitted when the drive unit is moved to the attaching direction, and a coming-off prevention part, which prevents coming-off of the connecting part from the fitted part when the drive unit has been moved to the attaching direction, the first positioning part is provided in the fitted part and the coming-off prevention part, the abutting part is the positioning rib which is protruded from the wall part, and the auxiliary positioning part is an auxiliary positioning rib which is protruded from the wall part.

* * * * *